United States Patent [19]

Zwicker

[11] 4,248,384

[45] Feb. 3, 1981

[54] CUTTING TORCH HAVING INTEGRAL HEAD MIXER

[75] Inventor: Roger D. Zwicker, Arlington, Tex.

[73] Assignee: Victor Equipment Company, Denton, Tex.

[21] Appl. No.: 59,050

[22] Filed: Jul. 19, 1979

[51] Int. Cl.[3] ..... B05B 7/06

[52] U.S. Cl. ..... 239/419.3; 239/424.5

[58] Field of Search ..... 266/48; 239/424.5, 419.3, 239/427.3, 427.5, 428, 429, 433

[56] References Cited

U.S. PATENT DOCUMENTS

| | | | |
|---|---|---|---|
| 2,371,970 | 3/1945 | Marra | 239/424.5 X |
| 2,520,018 | 8/1950 | Eicher | 239/424.5 X |
| 3,091,281 | 5/1963 | Clark | 239/424.5 X |
| 4,022,441 | 5/1977 | Turney | 239/424.5 X |

*Primary Examiner*—Robert B. Reeves
*Assistant Examiner*—Gene A. Church
*Attorney, Agent, or Firm*—Wofford, Fails & Zobal

[57] ABSTRACT

A cutting torch that obviates the tendency to have flashback and sustain burning yet have the inherent flexibility of injector type mixer torches, including a cutting oxygen valve and passageway, a mixing oxygen valve and passageway, a fuel gas valve and passageway, a head having a tip end and having passageways for cutting oxygen and fuel-oxygen mixture and having the improvement characterized by having the fuel-oxygen head passageway comprised of the first oxygen passageway drilled from the oxygen passageway end and in alignment with the oxygen passageway and intersecting a second oxygen passageway drilled from the tip end of the head and with a first diameter; a third fuel passageway drilled from the fuel passageway end and in alignment with the fuel passageway end and intersecting a fourth fuel and oxygen passageway drilled from the tip end in the head and communicating with the second oxygen passageway and having a common center line with the second oxygen passageway and having a second diameter larger than the first diameter such that the oxygen has a high velocity and aspirates the fuel from the third fuel passageway into the fourth passageway; and a fifth passageway drilled from the tip end and having a common center line with said second and fourth passageway and having a third diameter larger than the second diameter of the fourth passageways so as to afford a low velocity region for sustantially uniform admixing of the fuel and oxygen before entering the tip end. Preferably the oxygen passageway has a copper spiral adjacent the first oxygen passageway for preventing flashback.

3 Claims, 4 Drawing Figures

CUTTING TORCH HAVING INTEGRAL HEAD MIXER

FIELD OF THE INVENTION

This invention relates to torches. More particularly, it relates to cutting torches, either the straight cutting type or the attachment type, having a plurality of passageways for the cutting oxygen and oxygen-fuel mixture. In a particular aspect it relates to an improvement in cutting torches employing integral head mixer.

DESCRIPTION OF THE PRIOR ART

The advent of welding solved many problems that had plagued manufactures earlier. The use of torches, such as cutting torches, welding torches, heating torches and the like, also helped the repairmen perform a variety of repairs on the site instead of having to return an article to the factory to be repaired. There have been employed in the prior art a wide variety of types of torches. One the types is known as the injector type mixer in which one of the gases being flowed down a preheat tube is emitted in a high speed stream to aspirate the other gas into admixture therewith for heating before cutting oxygen is used. In theory, the injector type mixers have offered more flexiblity than other type mixers. In actual use, however, injector type mixers have been relatively expensive, had a tendency to have sustained burning on flashback, to burn up the torch when used with certain fuel gases such as acetylene and the like. Injector designers in the past have worked to try to simplify the manufacture of the torches while alleviating difficulties with the prior art element such as flash-back.

One of the ways in which the prior art designers have attempted to eliminate flashback was the use of exceptionally small diameter passageways and employing a plurality of the passageways to supply, for example, oxygen and fuel gas.

There are a wide variety of prior art illustrated in the United States Patents. These include patents such as U.S. Pat. No. 2,198,342, although there are other patents extending back to U.S. Pat. No. 1,262,351, as early as April, 1918, that show the use of mixing spirals. U.S. Pat. No. 1,276,893 shows intricate passageways to prevent backfiring of a torch. U.S. Pat. No. 2,263,655 shows a pipe coupling having a sprial fin 20. In U.S. Pat. No. 2,198,342, the use of a mixer and an aspirating jet of oxygen is shown. Experience with that torch indicated, however, that sustained burning could be experienced on flashback unless the respective mixers and mixer orfices were changed out with different fuel gases. The use of a multiplicity of small diameter appatures has resulted in very expensive manufacture of the torches where they have been drilled from multiple directions in head. Moreover, the use of a plurality of tubes welded to a common head with an integral mixer passageway was relatively infeasible and expensive because of the plurality of passageways that had to be drilled to conduct the oxygen to admix with the fuel in order to eliminate flashback.

Thus, it can be seen that the prior art did not provide a simple, economical, easily drilled head with integral mixer in a cutting torch that alleviated the difficulties of the prior art such as sustained burning on flashback and the like.

SUMMARY OF THE INVENTION

Accordingly, it is an object of this invention to provide a torch that obviates the tendency to have sustained burning on flashback and the other disadvantages of the prior art, yet is economical, and readily formed without requiring the multiplicity of small diameter holes with tendency to break bits and the like, yet still acheive the versatility of injector type mixer torches.

It is a specific object of this invention to provide a cutting torch that has the versatility of the injector type mixers, can be operated on any gaseous welding fuels, even at low pressure, yet alleviate the difficulties with the prior art and provide an integral head type mixer with all of its advantages.

These and other objects will become more clearly apparent from the descriptive matter hereinafter, particularly when taken with the appended drawings.

In accordance with this invention there is provided a torch, such as a cutting torch, that obviates the tendency to have flashback and sustained burning with certain fuels, such as acetylene, yet still achieve the flexibility theoretically inherent in injector type mixer torches. The straight cutting torch or torch and handle combined includes a cutting oxygen valve and passageway, a mixing oxygen valve and passageway, a fuel gas valve and passageway, a head having a tip end for having a tip affixed thereto and having a head passageway for cutting oxygen and a head passageway for fuel-oxygen mixture and having the following improvement. The improvement comprises having the fuel-oxygen head passageway comprised of the first oxygen passageway drilled from the oxygen passageway end and in alignment with the oxygen passageway and intersecting a second oxygen passageway drilled from the tip end of the head and with a first diameter; a third fuel passageway drilled from the fuel passageway end and in alignment with the fuel passageway and intersecting a fourth fuel and oxygen passageway drilled from the tip end in the head and communicating with the second oxygen passageway and having a common center line with the second oxygen passageway and having a second diameter larger than the first diameter such that the oxygen has a high velocity and aspirates the fuel from the third fuel passageway into the fourth passageway; and a fifth passageway drilled from the tip end and having a common center line with said second and fourth passageway and having a third diameter larger than the second diameter of the fourth passageways so as to afford a low velocity region for sustantially uniform admixing of the fuel and oxygen before entering the tip end. Preferably the oxygen passageway has a copper spiral adjacent the first oxygen passageway for preventing flashback.

DESCRIPTION OF THE PREFERRED EMBODIMENTS

Figure 1:
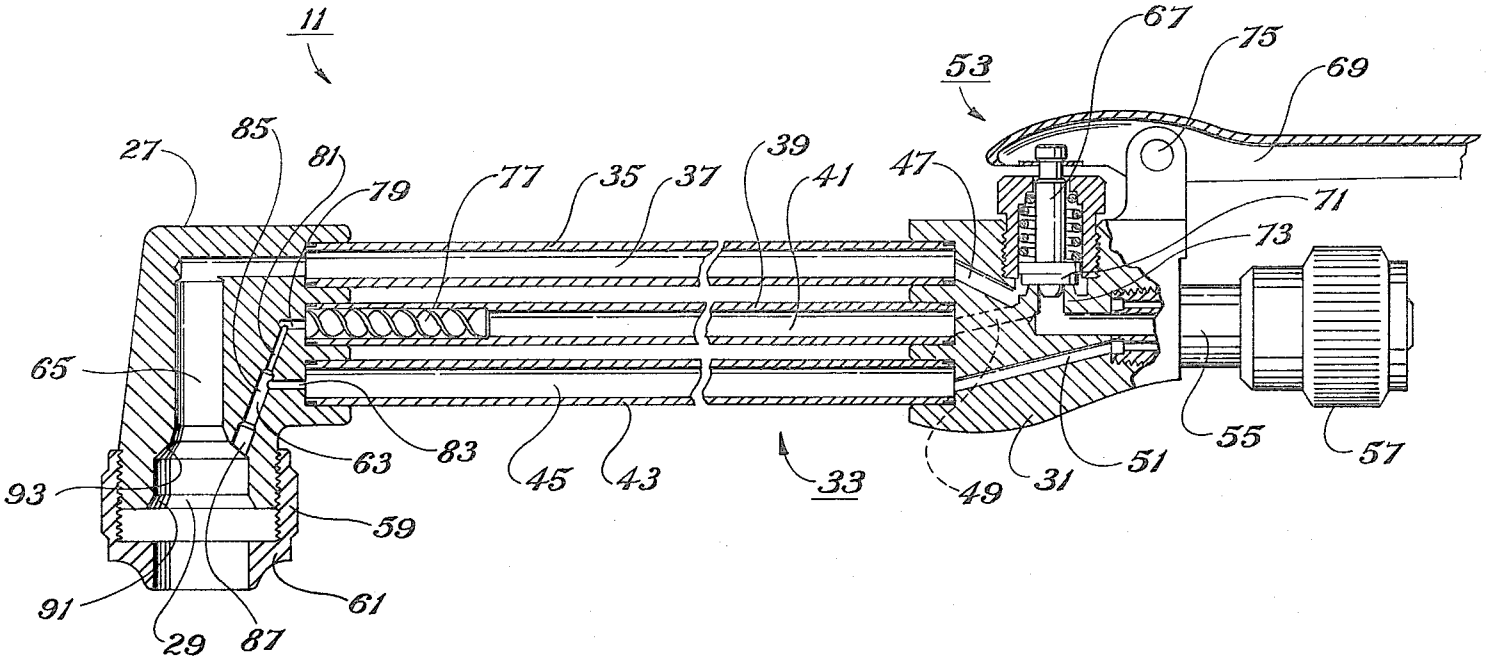
FIG. 1 is a cross sectional view of a cutting attachment type torch in accordance with one embodiment of this invention.
Figure 3:
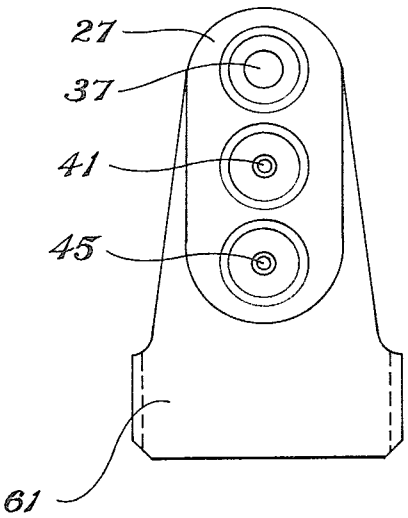
FIG. 3 is an end view from the fuel and oxygen passageway end, showing the head of the cutting torch of FIG. 2.
Figure 2:
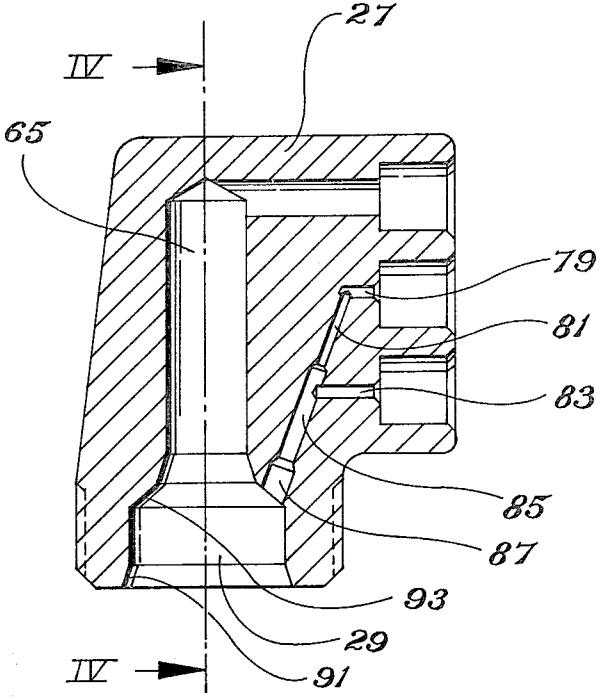
FIG. 2 is a cross sectional view of the cutting torch head with integral mixer in accordance with the embodiment of FIG. 1.
Figure 4:
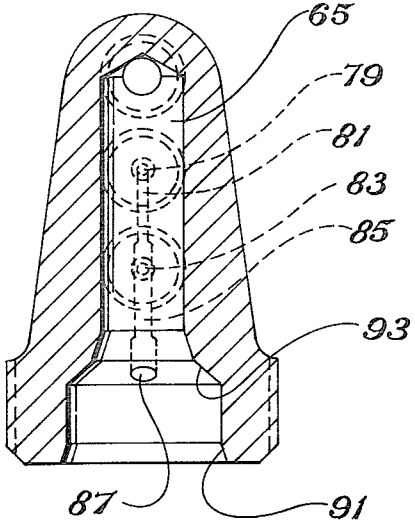
FIG. 4 is a cross sectional view of the head of FIG. 2 taken along the line of IV—IV.

Referring to FIG. 1 there is illustrated a cutting attachment type torch 11, such as is employed by a welder. The cutting torch 11 includes a torch head 27 having a tip end 29, a body 31 and respective interconnecting tubes 33. As illustrated there are three tubes 33 that are integrally connected, as by welding, silver soldering or the like, with the head 27. The three tubes comprise a cutting oxygen tube 35 having a cutting oxygen passageway 37 penetrating longitudinally thereof; mixing oxygen tube 39 having a mixing oxygen passageway 41 penetrating longitudinally thereof; and a fuel tube 43 having a fuel gas passageway 45 pentetrating longitudinally thereof. Each of the tubes are also integrally affixed, as by welding, sliver soldering or the like, to the body 31 so as to connect with respective cutting oxygen passageway 47, mixing oxygen passageway 49 and fuel passageway 51. The torch also includes a cutting oxygen valve and lever assembly 53 interposed in the cutting oxygen passageway 47, and a mixing oxygen valve (on the back side of the cutting oxygen valve), interposed in the mixing oxygen passageway 49. The fuel gas is controlled by a fuel valve on the handle to which this cutting attachment is designed to attach.

The torch head 27 is a so-called ninety degree (90°) torch head, such as employed by a welder to orient the torch tip at substantially ninety degrees (90°) to the remainder of the torch to facilitate observation of the work being performed. If desired, the head may be of any other orientation such as straight ahead, as employed in machine welding operations, or the like. As illustrated, the torch head 27 has a threaded section 59 adjacent its tip end 29 for attaching a tip thereto, the threaded section 59 being covered by a thread protector 61. The torch head 27 contains a preheat passageway 63 and a cutting oxygen passageway 65. The cutting oxygen passageway 65 terminates centrally of the torch head portion where the tip will be affixed at the tip end 29. The preheat passageway terminates eccentrically thereof so as to form a concentric bore that will form a concentric annular chamber in conjunction with a torch tip that is affixed at the tip end 29. As is recognized, the torch tip that will be affixed has a centrally disposed passageway for cutting oxygen and a plurality of passageways disposed concentrically thereabout for the mixture of fuel and oxygen. Any of the conventional torch tips may be employed, since they have a shoulder that is sealingly abuts the mating portion of the torch head such that the cutting oxygen passageway is isolated from the fuel and oxygen chamber and passageways, as illustrated in U.S. Pat. No. 4,022,441 "Universal Torch", inventor Larry R. Turney, assigned to Victor Equipment Company or U.S Pat. No. 4,030,710 "Floating Tube Torch", inventor Larry R. Turney, assigned to Victor Equipment Company, the contents of which are incorporated herein by reference.

Typically, the torch tip and the torch head will be formed of corrosion resistant metallic alloy, such as copper alloy, stainless steel, or the like.

The torch tubes 33 have substantially similar structure and are sealingly affixed so as to define sealed passageways for, respectively, the cutting oxygen, the mixing oxygen, and the fuel upstream of the head 27. The tubes may be formed of any of the conventional material, such as metal tubes, as of bronze, stainless steel, and the like.

The body 31 is ordinarily formed of a metallic alloy, such as a copper element alloy, so as to resist corosion, yet sustain the relatively rough treatment that is frequently accorded it by welders, workmen and the like. As illustrated, the body 31 has respective three recesses, similarily as did the head 27, receiving an integrally affixed to the respective tubes 35, 39 and 43.

The respective oxygen flow control valve, and the cutting oxygen valve are conventional and are described in other patents such as U.S. Pat. No. 3,873,038, "Precision Torch Assembly," inventor Richard W. Miller, assigned to Victor Equipment Company, the contents of which are corporated herein by reference.

As is recognized, the upstream assemblies 55 and 57 are sealingly connected to the head of a torch handle which, in turn, has respective hose connectors that are connected with hoses from pressure regulators connected to respective pressurized containers of high pressure oxygen and high pressure fuel gas, such as acetylene or the like.

The cutting oxygen flow control 53 may comprise any of the conventional cutting oxygen flow control valves that are employed. The cutting oxygen flow control valves have changed little over the years and satisfactory cutting oxygen flow control valve is illustrated in U.S. Pat. No. 2,198,342. Basically, the illustrated cutting oxygen flow control valve comprises a poppet member 67 that is connected with the lever 69 such that the resilient portion 71 is moved from the seat 73 to allow oxygen to flow through the valve when the lever 69 is depressed about the fulcrum point 75. The lever 69 on the cutting oxygen flow control valve may be pivotally mounted so as to be operable by the finger and on the same side as the tip end 29, or it may be pivotally mounted on the diametrically opposite side of the body 31, as illustrated, so as to be operable with the thumb or hand of the welder. As long as it operates the poppet interiorly of the valve to control the flow of the cutting oxygen, the arrangement is frequently altered in the same line of torches.

As indicated hereinbefore, frequently preheat tube assemblies included diffuser sections and the like within the torch such that the mixing occured upstream of the head 27. In this invention, however, the fuel and mixing oxygen have separate passageways such that there is no mixing until the head 27. Specifically, the mixing oxygen passageway 41 contains a copper spiral 77 immediately adjacent the head 27 to alleviate problems with flashback. Apparently the copper spiral removes heat from mini flashback of the admixture of fuel and oxygen and prevents its burning in the oxygen tube 39. As illustrated, the spiral 77 is formed of copper or highly heat conductive copper based alloy. It is possible to employ aluminum or other heat conductive metals.

The primary impact of this invention, however, is in the integral head mixer 27, FIGS. 1–4. Heretofore, as indicated hereinbefore, a plurality of small passageways had to be drilled (with resultant expensive breakage of small bits, high rejection rates and the like). In this invention, however, the preheat passageway in the head 27 has a first oxygen passageway 79 that consists essentially of only a single passageway of relatively large diameter of about 0.043 inch drilled from the oxygen passageway end in alignment with the oxygen passageway and intersecting a second oxygen passageway 81 drilled from the tip end 29 and with a first diameter. The first diameter may be, for example about 0.040 inch. It is apparent, of course, that the diameters are given by way of illustration, are not to be taken in a limiting sense, but only as a description of a best mode and to afford the reader a feel for relative sizes. The head 27 also includes a third fuel passageway 83 drilled from the fuel passageway end and in alignment with the fuel passageway 45. The third fuel passageway 83 intersects a fourth fuel and oxygen passageway 85. The fourth fuel and oxygen passageway 85 is drilled from the tip end 29 and has a common center line with the second oxygen passageway 81 and has a second diameter that is larger than the first diameter such that the oxygen has a high velocity when entering the fuel and oxygen passageway 85 and will aspirate the fuel from the third fuel passageway into the fourth passageway. In order to obtain the desired results, the second diameter must be at least twenty five percent (25%) larger than the first diameter. Preferably it is no more than twice the diameter of the first diameter. Expressed otherwise, where a passageway of 0.040 inch is employed as the first diameter, the second diameter should be at least 0.050 inch and preferably no more than 0.080 inch. Typically, the diameter may be about 0.052 inch for the second diameter.

The preheat passageway 63 in the head 27 also includes a fifth passageway 87 drilled from the tip end and having a common center line with the second and fourth passageways. The fifth passageway 87 has a third diameter larger than the second diameter of the fourth passageways so as to afford a low velocity region for substantially uniform admixing of the fuel and oxygen before entering the fuel and oxygen chamber in the tip end after a tip has been inserted. The third diameter of the fifth passageway is preferably at least twice as large as the second diameter and no more than four times as large as the second diameter. For example, when the second diameter is about 0.052 inch, the third diameter is about 0.125 inch.

The receiving end 29 of the head 27 has an outer frusto-conical section 91, the walls of which make an angle of thirty nine degrees (39°), fifty three minutes and thirty seconds. An interior frusto-conical section 93 has its walls making an angle of ninety four degrees (94°) and thirty four minutes with respect to each other, or forty nine degrees (49°) and seventeen minutes with respect to the central longitudinal axis of the cutting oxygen passageway 65. Central longitudinal axis of the preheat passageway 63 makes an angle of twenty degrees (20°) with respect to the central longitudinal axis of the cutting oxygen passageway 65.

In operation, the torch 11 is assembled as illustrated and described hereinbefore and connected by appropriate hoses at the respective oxygen and fuel inlet passageways and valves with respective oxygen and fuel sources. The desired heating flame is provided at a tip that has been inserted at the tip end 29. The flame is provided by adjusting the fuel and oxygen flow control valves. The work piece is then heated till the molten metal is achieved at this time, the lever 69 is pulled towards the torch to open the cutting oxygen flow control valve and start the cutting operation. The cutting oxygen further effects burning and melting of the metal and flowing of the molten metal from the cuts being made. The desired operation is completed. The cutting oxygen flow control valve is turned off. Thereafter, the oxygen and the fuel flow control valves are turned off until it is desired to employ the torch again.

While manually operated cutting torch attachment having the fuel valve on a separate handle has been described herein, it is in this type torch that the economies being realized in the integral mixing head are now most useful, it is also apparent that such an approach can be employed in any appropriate torch assembly, as in cutting torches, per se, as well as in automated machine torches or the like.

The significant advantages of this invention are that an economical readily drilled torch head is provided to allow providing an economical torch that can be employed to alleviate disadvantages of the prior art while achieving the advantages of the injector type mixer torches with very little danger of flash-back or sustained burning from a flashback and usable with a variety of fuels.

Thus it can be seen that this invention achieves the objects deliniated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

I claim:

1. In a torch assembly that includes:

a. a cutting oxygen valve and passageway, b. a mixing oxygen valve and passageway, c. a fuel gas valve and passageway, and d. a head having a tip end for having a tip affixed thereto and having a head passageway for cutting oxygen and respective head passageways for fuel and oxygen, the improvement comprising:

e. an integral head mixer having within said head a single preheat mixing passageway for admixing the fuel and oxygen so as to form a universal mixer without requiring special tip mixers for specific fuel gases and tip sizes and consisting essentially of having said fuel and oxygen head passageways comprised of a first oxygen passageway (79) drilled from said oxygen passageway end and in alignment with said oxygen passageway and intersecting a second oxygen passageway (81) drilled from said tip end and with a first diameter; a third fuel passageway (83) drilled from said fuel passageway end and in alignment with said fuel passageway; a fourth fuel and oxygen mixing passageway (63); said third fuel passageway (83) intersecting said fourth fuel and oxygen mixing passageway (63) such that the fuel is aspirated from said third fuel passageway by a high velocity oxygen stream into said fourth fuel and oxygen passageway; said fourth fuel and oxygen passage-way being drilled from said tip end and having a common center line with said second passageway (81) and communicating with said second passageway and having a second diameter larger than said first diameter of said second passageway such that said oxygen has a high velocity and aspirates said fuel from said third fuel passageway (83) into said fourth fuel and oxygen passageway (63); and a fifth mixing passageway (87) drilled from said tip end and having a common center line with said second and fourth passageway and communicating with said second and fourth passageway and having a third diameter larger than said second diameter of said fourth passageway so as to afford a low velocity mixing region for substantially uniform admixing of said fuel and oxygen before entering said tip end and having two respective sealing seating surfaces intermediate said fifth mixing passageway (87) and, respectively, said cutting oxygen passageway and said tip end such that only two sealing seating surfaces are necessary for sealingly receiving said tip.

2. The torch of claim 1 wherein said oxygen passageway has a copper spiral adjacent said first oxygen passageway for preventing flashback.

3. The torch of claim 1 wherein said second diameter is at least twenty five percent (25%) larger than said first diameter and no more than twice as large and said third diameter is twice as large as said second diameter and no more than four times as large as said second diameter.

* * * * *